US005665147A

United States Patent [19]

Taylor et al.

[11] Patent Number: 5,665,147

[45] Date of Patent: Sep. 9, 1997

[54] COLLECTOR PLATE FOR ELECTROSTATIC PRECIPITATOR

[75] Inventors: Robert W. Taylor, Overland Park, Kans.; Lewis Stokes, Hilliard, Fla.

[73] Assignee: BHA Group, Inc., Kansas City, Mo.

[21] Appl. No.: 530,300

[22] PCT Filed: Apr. 27, 1993

[86] PCT No.: PCT/US93/03932

§ 371 Date: Sep. 28, 1995

§ 102(e) Date: Sep. 28, 1995

[87] PCT Pub. No.: WO94/25170

PCT Pub. Date: Nov. 10, 1994

[51] Int. Cl.[6] ..... B03C 3/47

[52] U.S. Cl. ..... 96/72; 96/87; 96/98

[58] Field of Search ..... 96/65, 62, 69–72, 96/84, 86, 87, 98, 100

[56] References Cited

U.S. PATENT DOCUMENTS

| | | | |
|---|---|---|---|
| 1,345,790 | 7/1920 | Lodge | 96/62 |
| 2,815,824 | 12/1957 | Armstrong et al. | 96/72 |
| 2,826,262 | 3/1958 | Byerly | 96/71 |
| 2,996,144 | 8/1961 | Phyl | 96/71 |
| 3,660,968 | 5/1972 | Dyla et al. | 96/71 |

FOREIGN PATENT DOCUMENTS

| | | | |
|---|---|---|---|
| 1158043 | 11/1963 | Germany | 96/71 |
| 926128 | 5/1963 | United Kingdom | 96/71 |
| 9425170 | 11/1994 | WIPO | 96/98 |

*Primary Examiner*—Richard L. Chiesa

*Attorney, Agent, or Firm*—Kokjer, Kircher, Bowman & Johnson

[57] ABSTRACT

A collector plate (10) for an electrostatic precipitator is provided. Collector plate (10) has end portions (12) which are substantially symmetrical about the plane of the collector plate (10). Each end portion (12) is preferably polygonal and has a substantially unobstructed interior. Dimples (80) may be located in end portions (12) to improve rigidity of the plate. Collector plate (10) yields better precipitation results because of the minimal or nonexistent deflection of plate (10) into voltage discharge regions surrounding electrodes (36) within the precipitator. Precipitation results are further improved because power input to the precipitator is not limited by an instable electric field resulting from irregularities in the surface of plate (10).

9 Claims, 3 Drawing Sheets

COLLECTOR PLATE FOR ELECTROSTATIC PRECIPITATOR

TECHNICAL FIELD

This invention relates to collector plates for electrostatic precipitators, and more particularly to a collector plate structure which produces new and useful precipitation results.

BACKGROUND ART

It is well known that the performance of an electrostatic precipitator is highly dependent on the efficiency of particulate collection in the precipitator. Particularly, high voltage discharge electrodes located between parallel collector plates in a precipitator electrically charge particulate laden gas flowing through the precipitator. The electrically charged particulates are attracted to, and collected by, oppositely charged collecting surfaces of the collector plates. The cleaned gas may then be further processed or safely discharged to the atmosphere.

The maximum operating voltage of each electrode in a precipitator is determined by the distance from that electrode to the collecting surface. Since it is conventional for the electrodes in a precipitator to bisect the annular distance between collector plates, maximum operating voltage is likewise determined by the distance between collector plates. The greater this distance, the greater the maximum operating voltage. Because the implied voltage within the precipitator is reduced as the collector plate bends closer to the electrode it is desirable for collector plates, once they are positioned within a precipitator, to be sturdy and rigid and to resist lateral movement.

Many attempts have been made to produce a collector plate that will resist deflection. For instance, as shown in U.S. Pat. Nos. 2,815,824 and 2,826,262, it is known to place a series of triangular-shaped baffles along the length of a collector plate to increase the vertical stiffness of the plate. While such an arrangement aids in preventing plate deflection, manufacturing is expensive and cumbersome. More modernly, as shown in the preferred embodiment of the present invention, dimples or bent portions along the vertical length of a collector plate are utilized to increase the rigidity of the plate. Additionally, reducing the size of the collector plate is known to aid in the prevention of plate deflection.

It is also known that increasing the cross-sectional dimension of the ends of a collector plate provides for a more rigid structure and helps reduce collector plate deflection. Particularly, it has been found that the rigidity of a collector plate increases as the cross-sectional area of the ends of the plate increases. Mechanically rolling each end of a collector plate is a commonly used method to increase its cross-sectional area. It is believed that all prior art collector plates having rolled or bent ends, while varying in design, have been asymmetrical about the central longitudinal plane of the collector plate. For instance, it is common to roll the end portion of a collector plate to provide a semi-circular or similar embodiment at the ends of the collector plate thereby leaving an open portion at one side of the plate at each end of the plate.

Such prior art collector plates, while reducing plate deflection, have more mass resulting from the rolling process aligned on one side of a central longitudinal plane of the plate than on the opposite side of this plane. Therefore, these plates tend to bow or deflect to a greater extent towards the side of the plate having the least mass at its ends.

To overcome this problem, it is common practice in the precipitator art to vertically align these asymmetrical plates in rows within the precipitator in an alternating fashion. In other words, a first plate in a series of plates will have a greater mass at its ends on a first side of the plate. As a result, the plate will tend to bow in a first direction. The next plate, however, will be reversed so that the greater amount of mass at its ends are located on the side of the plate that is opposite to the arrangement of the first plate. Accordingly, this second plate will tend to deflect in the opposite direction. This arrangement is repeated throughout the precipitator.

While the foregoing described alternating collector plate arrangement reduces the ill-effects of collector plate deflection, it illustrates the design problem inherent in the collector plates described. Moreover, deflection is not prevented, but only compensated. Additionally, collector plates of this type tend to bow during rapping for cleaning of the plates.

Additionally, a further problem exists with collector plates having ends with increased cross-sectional areas. As discussed, it is desirable to prevent deflection of the plate into the electrical discharge field created by the voltage discharge electrodes. However, as the cross-sectional area of the end of a plate is increased thereby increasing the rigidity of the plate, the end of the plate itself may impinge on the electric field being generated by the electrode, thereby reducing the implied voltage within the precipitator and hindering collection efficiency.

Additionally, the opened-ends of these prior art devices causes the distance from electrode to plate to be highly irregular which, in turn, causes instability in the electric field. Instability in the electric field limits the maximum average power input to the precipitator. Accordingly, deflection of collector plates continues to be an on-going problem in the precipitator art.

SUMMARY OF THE INVENTION

The present invention provides an electrostatic precipitator collector plate having ends that are geometrically shaped to provide a maximum amount of rigidity to the plate, but that do not extend into the voltage field discharged by the electrodes. Particularly, the collector plate of the present invention is comprised of a substantially rectangular panel section made of sheet metal or similar material. In the preferred embodiment, this panel includes bent portions along its vertical length for improving the stiffness of the collector plate. Each end of the panel section is rolled or bent to form an enclosed cross-sectional area that is symmetrical about a central plane taken along the longitudinal length of the rectangular panel.

The preferred geometry of the end portion of the collector plate is pentagonal. Particularly, along the entire vertical length of each end of the panel, a section extends outwardly in both directions a predetermined distance and at a predetermined angle that is greater than 90 degrees when measured from the center of the panel. The angled portions are each bent in a respective plane that is parallel to the rectangular panel. At the outermost ends of these sections is a section or wall which extends perpendicularly to the panel and which interconnects these outermost ends. In the preferred embodiment, the collector plate is made of only one piece of material. Such a structure is accomplished by rolling and bending each end of the plate to the desired configuration.

The present invention provides a collector plate having uniquely shaped ends. It is important to understand that the geometrical cross-section of the end portion is not critical to this invention as long as it remains substantially symmetrical about a central longitudinal plane taken along the collector plate. It is preferred that the end portions are polygonal. Of primary importance however, is that each end element includes first and second sections forming an angle away from the vertex of these first and second sections and the end of the panel. It will be understood that this vertex is more precisely defined by the intersection of the vertical planes corresponding to each section and the panel. A remaining section, which could take on various shapes, interconnects the outermost ends of the first and second sections.

Such an arrangement provides for a collector plate having ends with an increased cross-sectional area for providing rigidity to the plate. As a result, bending and deflection of the collector plate has been substantially reduced to the point that, in many applications, deflection is nonexistent. Moreover, because the entire plate, including each end portion, is symmetrical, any deflection caused by a force normal to the panel on one side of the panel will be equal to the same force applied to the opposite side of the panel, although deflection will necessarily be in the opposite direction. Accordingly, the prior art problem of alternating plate positioning to compensate for deflection is overcome. Additionally, the symmetrical, closed ends improves the regularity of distance from electrode to plate. Thus the electrode sees substantially the same potential in all directions. As a result, the provision of the present invention of a more uniform plate surface improves the stability and uniformity of the electric field, thereby improving collection efficiency.

It should be understood that the geometrical configuration of the end portions of the collector plate of the present invention is not merely a means by which the plate can be fastened to a support structure. For instance, U.S. Pat. No. 1,345,790 shows early precipitator technology. In one embodiment of that invention, tubes in the shape of a triangle or other section are placed over each end of a collector plate. A slit in the tube permits the end of the collector plate to be disposed within the tube. However, the '790 patent does not teach a collector plate geometrically shaped like the present invention and is otherwise unconcerned with the objective of the present invention to provide a rigid collector plate with end portions that are precisely designed to maximize cross-sectional area while preventing intrusion of the plate into the discharge voltage field within the precipitator.

It is an object of the present invention to provide a new and improved collector plate that improves collection efficiency.

It is another object of the present invention to provide a collector plate that resists deflection and bending.

It is a further object of the present invention to provide a collector plate for electrostatic precipitators that is symmetrical and, accordingly, will not deflect more in one direction than another.

It is a further object of the present invention to provide a collector plate that permits maximum operational voltages to be used while preventing sparking.

It is an object of the present invention to provide a collector plate having enclosed end portions wherein the collector plate is made from a unitary piece of material.

It is another object of the present invention to provide a collector plate that has a longer life due to its increased rigidity.

It is still another object of this invention to provide a collector plate that does not laterally deflect during rapping for cleaning of the plate.

It is another object of the present invention to provide a collector plate having end elements that are pentagonal in shape.

It is an object of the present invention to provide a collector plate which substantially reduces or negates non-uniformity and instability of the electric field in the precipitator.

Other and further objects of the invention, together with the features of novelty appurtenant thereto, will appear in the course of the following description.

BRIEF DESCRIPTION OF THE DRAWINGS

In the accompanying drawings which form a part of the specification and are to be read in conjunction therewith, and in which like reference numerals are used to indicate like parts in the various views.

DETAILED DESCRIPTION OF THE PREFERRED EMBODIMENTS

Figure 1:
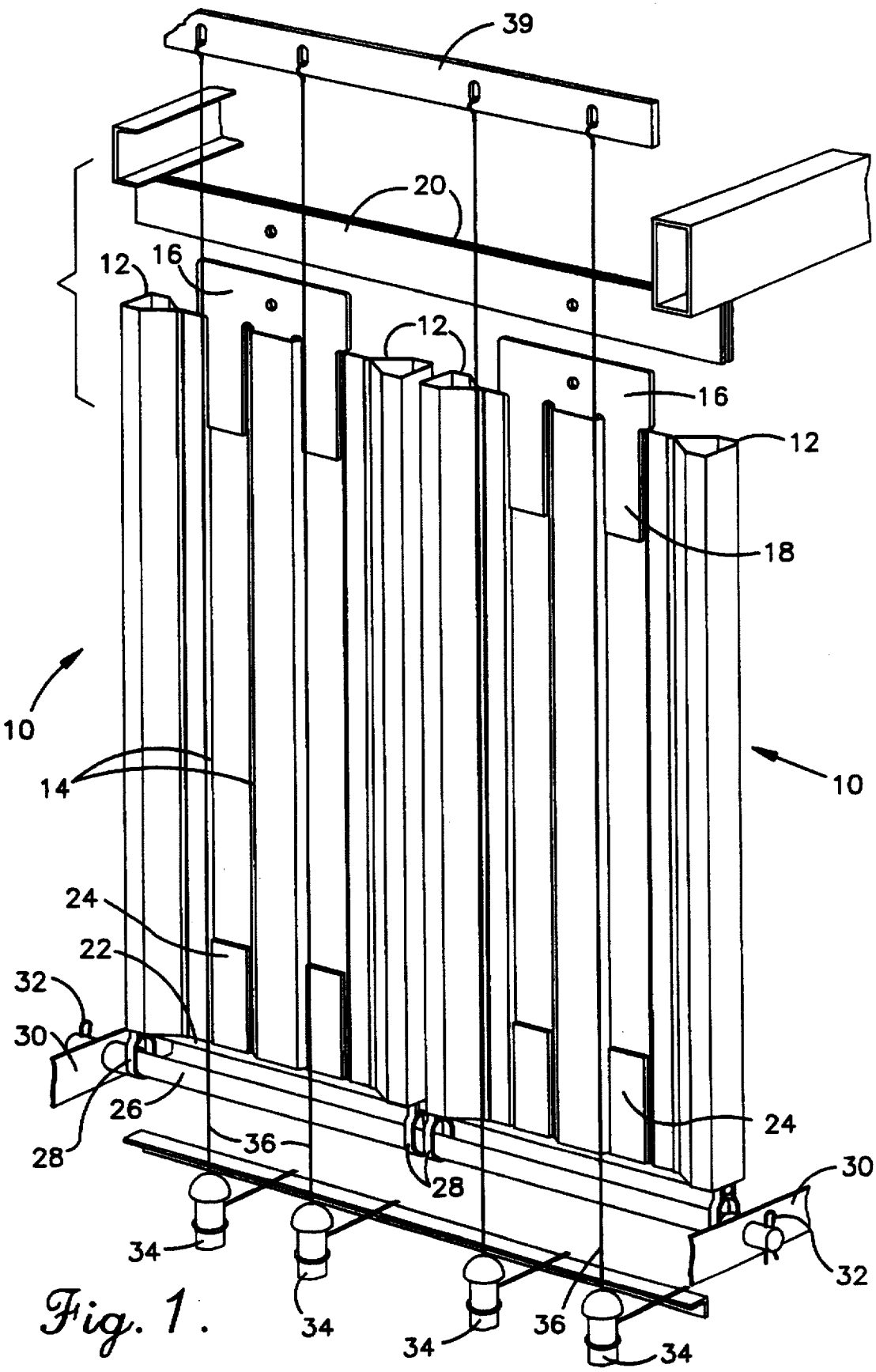
FIG. 1 is an expanded perspective view of two collector plates in accordance with the present invention shown positioned in an electrostatic precipitator.
Figure 2:
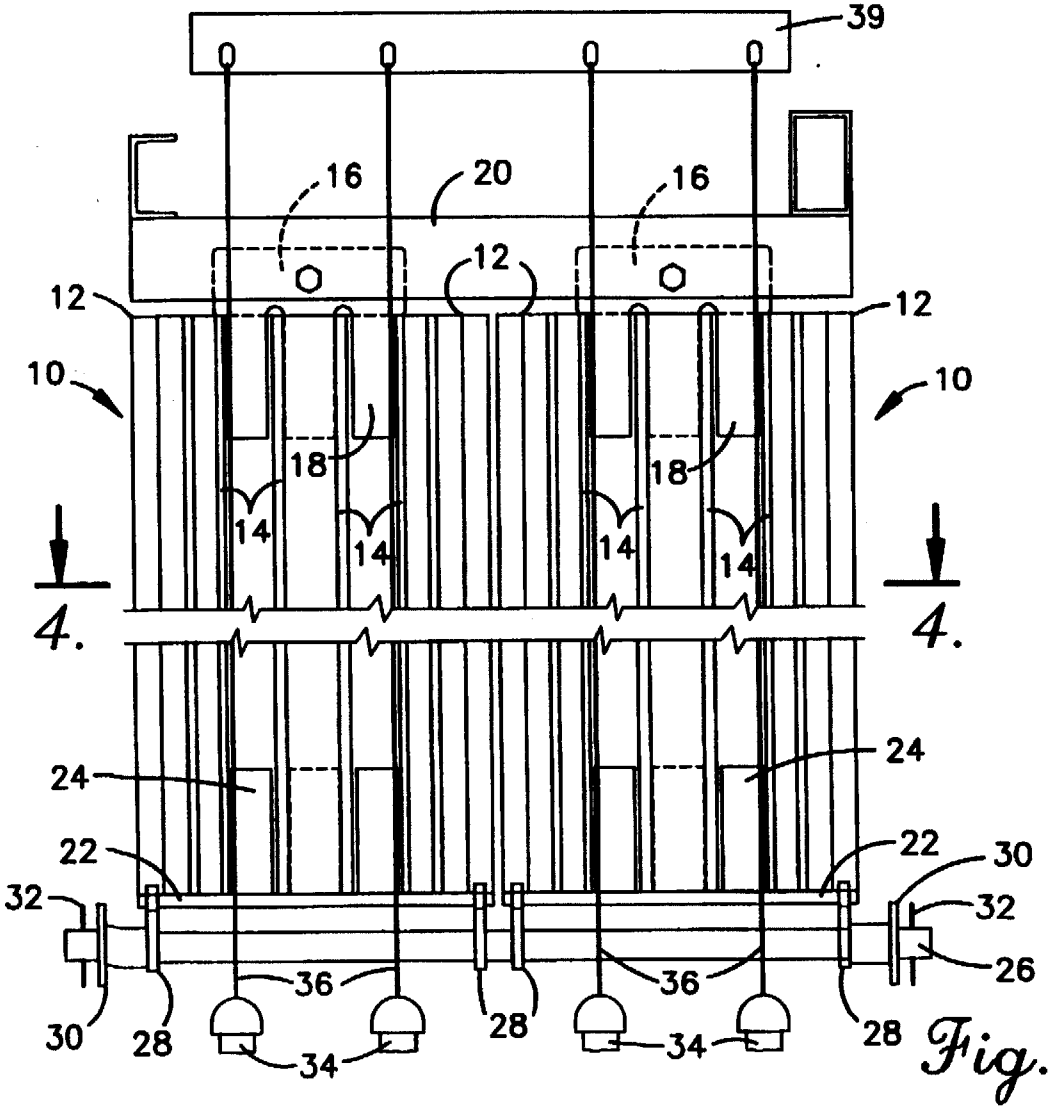
FIG. 2 is a side elevational view of two collector plates of the present invention in side-by-side relationship.

Referring initially to FIGS. 1 and 2, two collector plates are shown in side-by-side relationship as they would be positioned within an electrostatic precipitator. Each collector plate is denoted by the numeral 10. The collector plate has end portions 12 along the vertical length of collector plate 10. In the preferred embodiment, collector plate 10 has bent portions 14 for stiffening the plate 10. The preferred material for the collector plate 10 is 16 gauge or 18 gauge A 366 or A 606 steel.

Figure 3:
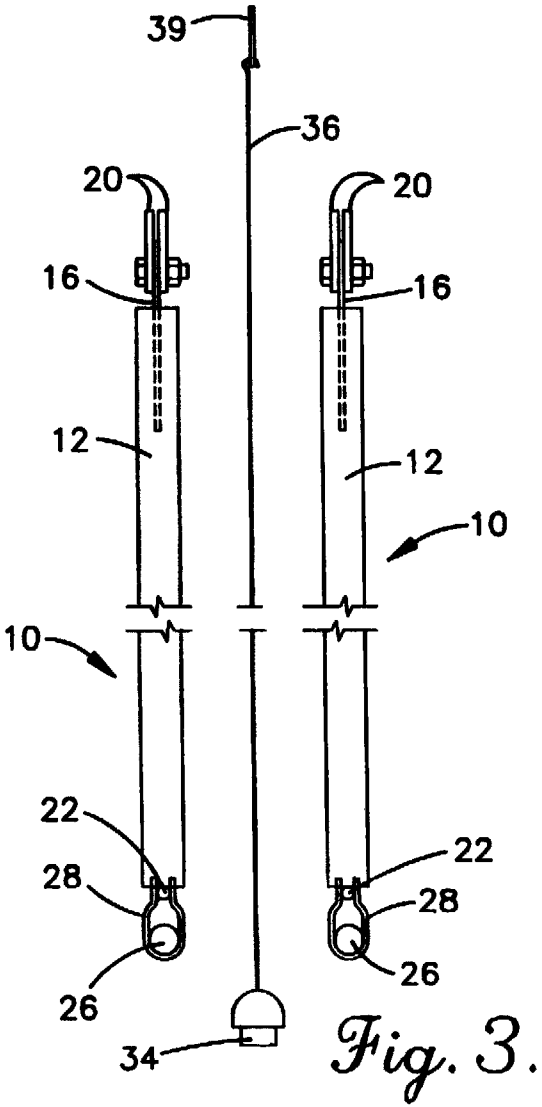
FIG. 3 is an end view thereof.

The preferred embodiment for installing each collector plate 10 within an electrostatic precipitator will now be described. Particularly, each plate 10 has a flange 16 connected at its upper end. As shown in FIG. 1, flange 16 preferably has downwardly extending fingers 18 which abut the plate 10 intermediate of bent portions 14. Flange 16 is generally welded, bolted, or otherwise fastened to plate 10. Flange 16 is then fastened to a bracket 20 within the precipitator by bolts or welding. As shown in FIG. 3, this is accomplished by bolts. In the configuration shown in FIG. 1, the electrostatic precipitator has a panel guide 22 having upwardly extending fingers 24 extending therefrom. Collector plate 10 is fastened, preferably by welding, to upwardly extending fingers 24. A guide tube 26 extends through ringlets 28 which are fastened to the lowermost portion of collector plate 10. In the preferred embodiment, spacer bars 30 having an aperture therein are positioned over each end of the guide tube 28 and a hitch pin 32 is placed through a small hole in the guide tube 28. It will be understood by those skilled in the art that any number of collector plates 10 could be aligned in a row, and that many parallel rows of collector plates will be present in the precipitator.

Still referring to FIGS. 1 and 2, voltage discharge electrodes 36 discharge electrical energy for forming voltage discharge regions. Particularly, electrodes 36 are connected to weights 34 in the manner shown. In the embodiment shown, an electrode 36 extends between one weight 34 and a high voltage frame 39. High voltage frame 39 is connected to support structure and a transformer/rectifier set (not shown) for providing electrical power. Preferably, two vertically extending wire portions are located adjacent each collector plate 10. Again, it should be understood that the manner in which collector plates 10 are shown positioned within an electrostatic precipitator is for illustrative purposes only, and any commonly known methods could be used.

Referring now to FIG. 2, a side elevational view of two side-by-side collector plates 10 of the present invention are shown positioned within an electrostatic precipitator. As seen more clearly in FIG. 2, downwardly extending fingers 18 and upwardly extending fingers 24 are positioned between bent portions 14. Thus, adjacent fingers extend on opposite sides of plate 10. In the preferred embodiment, collector plates 10 are not physically attached to each other.

Referring now to FIG. 3, an end view of two rows of collector plates 10 is shown with electrodes bisecting these two rows. Thus is provided the common arrangement of parallel rows of collector plates between which particulate laden gas will flow. Voltage discharged from electrodes 36 will electrically charge particulates. The charged particulates will attract to, and be collected by, collector plates 10.

Figure 4:
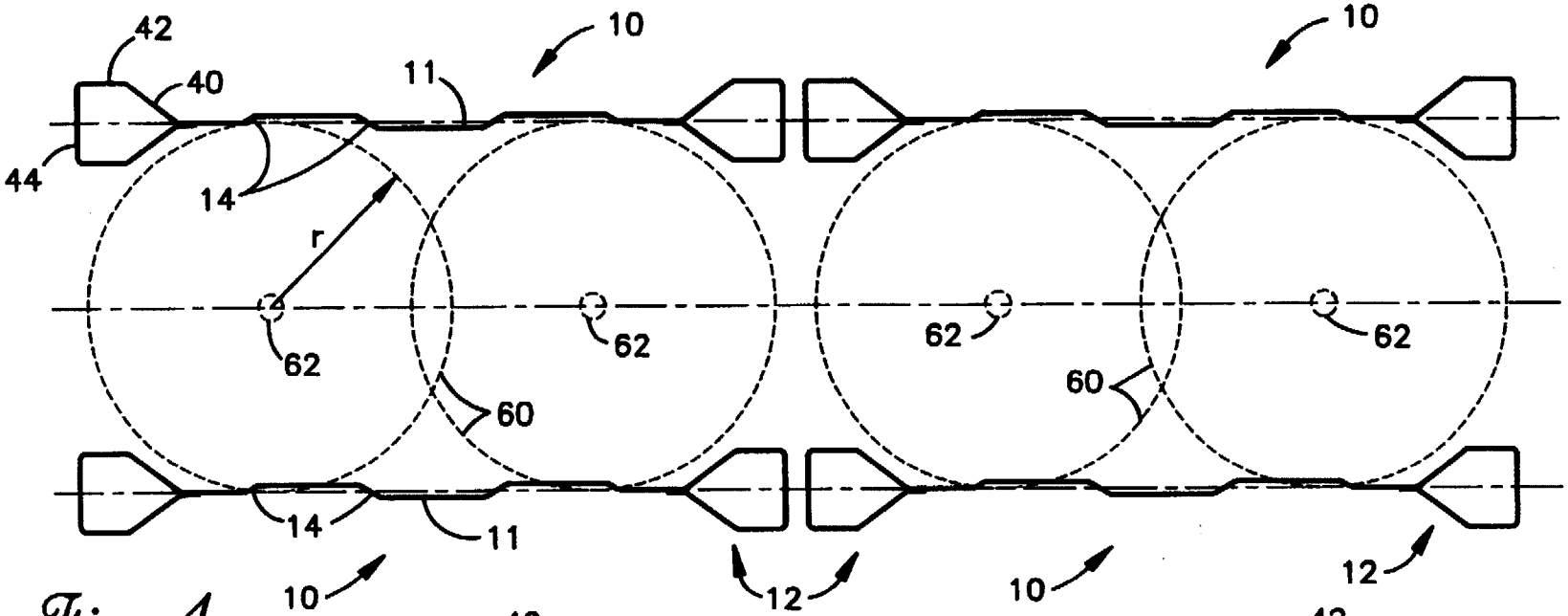
FIG. 4 is a top plan view taken along lines 4—4 of FIG. 2, also schematically showing voltage discharge regions.

Referring now to FIG. 4, which is a top plan view taken along lines 4—4 of FIG. 2, the important features of the present invention are more clearly seen. Particularly, the preferred embodiment of the end portion 12 of each collector plate 10 is shown. Collector plate 10 consists of a panel portion 11 having bent portions 14. Such an arrangement is known to the art and provides more stiffness to collector plate 10.

Each end of plate 10 is preferably comprised of a polygonal end section 12 that is closed along the length of the panel. Each end portion 12 generally comprises, in the preferred embodiment, two angled sections 40 extending outwardly from the central longitudinal plane of collector plate 10. Each section 40 extends a predetermined distance and then bends to form a side-wall section 42 which extends outwardly in a respective plane that is parallel to the central longitudinal plane of collector plate 10. This plane is vertical when collector plate 10 is hanging in position within a precipitator. Each section 42 then forms a right angle such that a wall section 44 extends laterally between sections 42 and perpendicularly to the central longitudinal plane of collector plate 10 for forming the enclosed end portion 12. Shown schematically in FIG. 4 are voltage discharge regions 60 formed around each electrode, represented schematically by the numeral 62.

During operation of the electrostatic precipitator, particulate laden gas flows between collector plates 10. The particulates are electrically charged by the electrical energy discharged by the electrodes. The charged particulates are then attracted to, and collected by, collector plates 10. The maximum operating voltage of a precipitator is determined by the radius r. This radius represents the distance between each collector plate 10 and the electrode, represented by a numeral 62. The greater the distance r, the greater the maximum operating voltage of the precipitator. Accordingly, once the spacing and corresponding maximum voltage selection for a particular precipitator is selected, collector plates 10 are positioned within the precipitator at the appropriate locations. During operation, for maximum collection efficiency to occur, the precipitator must be operating at maximum voltage. This is represented schematically in FIG. 4 where the radius r extends precisely to the point of the central longitudinal plane of each collector plate 10. Accordingly, if for some reason collector plate 10 bows or deflects into voltage discharge region 60, the implied voltage is reduced and the precipitator will not be operating at maximum collection efficiency. Moreover, such bending of a collector plate adds wear and electrical erosion to the plate thereby decreasing its useful life.

It has been found that the end portion 12 of the collector plate 10 of the present invention substantially prevents deflection of plate 10, and particularly the panel portion 11. In this regard, the angled portions 40 are specifically designed with the maximum operating voltage of the precipitator in mind. In this way, a particular angle θ can be determined to permit section 40 to extend outwardly as far as possible without impinging on voltage discharge region 60. Additionally, the remaining cross sectional area of end portion 12 resulting from the extending portions 42 and lateral portion 44 provide increased rigidity to collector plates 10.

Figure 5:
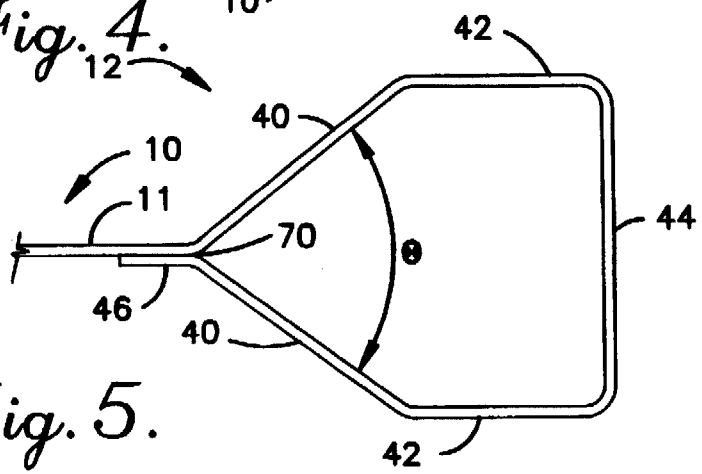
FIG. 5 is a fragmentary view of one end of a preferred collector plate of the present invention.

As seen more clearly in FIG. 5, the collector plate 10 of the present invention is preferably formed of one piece of metal. This is accomplished by bending collector plate 10 in the appropriate places to form the various sections 40, 42, and 44. Flange portion 46 in then welded to the panel 11 of collector plate 10 to form a unitary, rigid collector plate.

Particularly, the intersection of each section 40 forms an angle away from the vertex 70 of each section 40 and the end of the panel portion 11. As shown, the ends of each section 40 opposite vertex 70 bend to form section 42 and section 44. The resulting collector plate is symmetrical about the central longitudinal plane of collector plate 10. As a result, any forces normal to the plate 10, particularly at the panel portion 11, will cause the same amount of deflection regardless of which side of the plate is bearing the force. It should be understood that the collector plate of the present invention need not be made of one unitary piece of material, and various other ways of making the present invention, including the use of various component pieces, will be apparent to those skilled in the art. Moreover, the precise geometrical shape of the end portion 12 is not critical. For instance, the end portions 12 could be more triangular in nature by omitting the sections 42. Numerous other polygonal embodiments are possible. However, the preferred pentagonal embodiment shown in FIG. 5 has been found to yield a maximum collection efficiency because of the provision of an increased cross sectional area of end portion 12, that does not impinge into voltage discharged regions 60.

It will be apparent to those skilled in the art that the cooperation of many variables set forth herein produce maximum collection results. For instance, in addition to the geometrical shape of the collector plate of the present invention, location of each electrode 36 is also of primary importance. In this regard, it is most beneficial to position the electrodes such that the voltage discharge region 60, as defined by radius r, falls just short of intersecting with end portion 12 of collector plate 10. It should also be understood that the collector plate 10 of this present invention can be used in precipitators having other types of electrodes, such as rigid electrodes.

Figure 6:
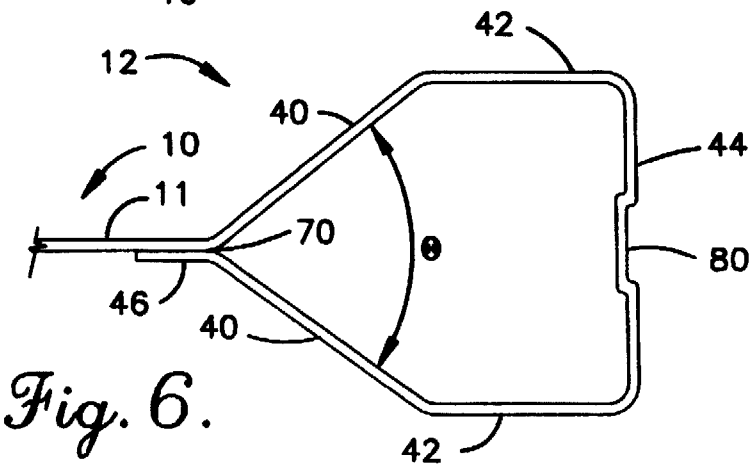
FIG. 6 is a fragmentary view of an alternate embodiment of one end of the collector plate.

FIG. 6 shows an alternate embodiment of the end portion of collector plate 10. Particularly, a dimple 80 is located in wall section 44. It should be understood that the present invention contemplates placing one or more dimples, or bent portions, in any or all of sections 40, 42 and 44 for stability purposes. The dimple 80 provides increased rigidity to collector plate 10. Preferably, dimple 80 extends the length of the plate 10.

While it will be apparent to those skilled in the art that the dimensions of the end portion 12 will vary with particular circumstances, it has been found that forming end portion 12 such that the portion 44 is approximately two inches in length, each portion 42 is approximately 1.5 inches in length, and the length from vertex 70 (as shown in FIG. 5) to the portion 44 is approximately 3.125 inches is advantageous.

From the foregoing it will be seen that this invention is one well adapted to attain all ends and objects here and above set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter and set forth are shown in the accompanying drawings Just to be interpreted as illustrative and not in a limiting sense.

Having thus described our invention we claim:

1. A collector plate for an electrostatic precipitator, said collector plate comprising:

a substantially rectangular panel;

a polygonal element at each end of said panel extending substantially along the vertical length of said panel, said polygonal element integrally formed with said panel and defining a closed periphery, thereby forming a substantially unobstructed enclosed region positioned symmetrically about the longitudinal plane of said collector plate, wherein said collector plate is formed of one unitary piece of material.

2. The collector plate of claim 1, wherein said polygonal element is shaped as a pentagon.

3. The collector plate of claim 1, wherein said polygonal element is triangular.

4. The collector plate of claim 1, wherein each said polygonal element is formed of bent metal and each said polygonal element has a flange extending therefrom and adjacent to said rectangular panel, wherein said flange and said rectangular panel are fixedly attached.

5. The collector plate of claim 1, wherein said polygonal element has at least one dimple for increasing the rigidity of said collector plate.

6. The collector plate of claim 1, wherein said rectangular panel has at least one dimple region for increasing the rigidity of said collector plate.

7. The collector plate of claim 1 in combination with said electrostatic precipitator.

8. A collector plate for an electrostatic precipitator, said collector plate comprising:

a substantially rectangular panel;

an end element integrally formed with said panel at each end of said panel, each said end element extending substantially along the vertical length of the panel for increasing the rigidity of said panel, each said end element comprising:

a first section and a second section forming an angle away from the vertex defined by the intersection of the planes of said first section, said second section, and said rectangular panel; and a third section integrally formed at the end of each of said first section and said second section opposite said vertex, forming a pentagonal end element with an unobstructed interior and a closed periphery that is symmetrical about the longitudinal plane of said collector plate.

9. A collector plate for an electrostatic precipitator, said electrostatic precipitator including at least one voltage discharge electrode positioned adjacent a first side of said collector plate for generating a voltage field with a magnitude represented by a radius r, said collector plate comprising:

a substantially rectangular panel;

an end element at each end of said panel extending substantially along the vertical length of the panel for increasing the rigidity of said panel, each said end element comprising:

a first section on said first side of the collector plate and a second section on the second side of the collector plate, said first and second sections forming an angle away from the vertex defined by the intersection of the planes of said first section, said second section, and said rectangular panel, wherein said first section is defined by a locus of points which are within 10% of the distance r from the voltage field defined by radius r; and a third section connected to the end of each of said first section and said second section opposite said vertex thereby forming a polygonal end element with an unobstructed interior and a closed periphery that is symmetrical about the longitudinal plane of said collector plate.

* * * * *